US010117518B2

(12) United States Patent
Huennekens et al.

(10) Patent No.: US 10,117,518 B2
(45) Date of Patent: Nov. 6, 2018

(54) LUMBAR SUPPORT ADJUSTER

(71) Applicant: EXEMPLIS LLC, Cypress, CA (US)

(72) Inventors: Adam Huennekens, Fullerton, CA (US); Paul Devries, Huntington Beach, CA (US); Peter Jeffery, Huntington Beach, CA (US); Mitchell Mulder, Huntington Beach, CA (US); Ryan Dibble, Irvine, CA (US)

(73) Assignee: EXEMPLIS LLC, Cypress, CA (US)

( * ) Notice: Subject to any disclaimer, the term of this patent is extended or adjusted under 35 U.S.C. 154(b) by 115 days.

(21) Appl. No.: 15/089,471

(22) Filed: Apr. 1, 2016

(65) Prior Publication Data

US 2017/0280876 A1 Oct. 5, 2017

(51) Int. Cl.
*A47C 7/46* (2006.01)

(52) U.S. Cl.
CPC ..... *A47C 7/462* (2013.01)

(58) Field of Classification Search
CPC ..... A47C 7/462
See application file for complete search history.

(56) References Cited

U.S. PATENT DOCUMENTS 4,601,514 A * 7/1986 Meiller ..... A47C 7/462 297/284.4
4,730,871 A * 3/1988 Sheldon ..... A47C 7/462 297/284.7
4,810,033 A * 3/1989 Kemmann ..... A47C 7/462 297/284.4
4,893,872 A * 1/1990 Sugai ..... A47C 7/462 297/284.8
6,092,871 A * 7/2000 Beaulieu ..... A47C 7/462 297/284.4
6,261,213 B1 * 7/2001 Frey ..... A63B 21/028 482/121
6,419,318 B1 * 7/2002 Albright ..... A47C 7/462 297/284.4
6,755,467 B1 * 6/2004 Chu ..... A47C 7/46 297/284.1
7,303,232 B1 * 12/2007 Chen ..... A47C 7/38 297/284.7
7,347,495 B2 * 3/2008 Beyer ..... A47C 7/462 297/284.3
7,445,287 B2 * 11/2008 Chou ..... A47C 1/026 297/230.14
8,308,240 B1 * 11/2012 Chou ..... A47C 7/462 297/284.4
8,573,697 B1 * 11/2013 Su ..... A47C 7/462 297/284.7
2005/0062323 A1 * 3/2005 Dicks ..... A47C 7/38 297/284.4

FOREIGN PATENT DOCUMENTS

JP 2014079521 A * 5/2014 ..... A47C 7/462

* cited by examiner

*Primary Examiner* — David R Dunn
*Assistant Examiner* — Tania Abraham
(74) *Attorney, Agent, or Firm* — Gordon & Rees LLP; Sean D. Flaherty; Kathryn K. Hull

(57) ABSTRACT

The disclosure herein relates to lumbar support adjustment for a chair. More specifically, the disclosure related to a lumbar support adjustment mechanism that moves forward and aft relative to the user.

7 Claims, 6 Drawing Sheets

LUMBAR SUPPORT ADJUSTER

FIELD

The disclosure herein relates to devices and methods for adjusting the lumbar support structures in chairs. More specifically, the disclosure related to a lumbar support adjustment mechanism that may be adjusted horizontally (forward and aft) and vertically (high and low), relative to the user.

BACKGROUND

An estimated 50% of people in the industrialized world suffer from back pain, with damage most frequently occurring in the lumbar region. For many the cause of the pain can be attributed to poor seat design. As more and more of the workforce are sitting for prolonged periods of time, it is critical to have chairs that provide proper support.

When choosing a chair that will be used for prolonged seated activities users should consider the following. Does the seat pan feel comfortable and fit your shape? Does the seat pan have an adjustable tilt? Is the seat height adjustable? Does the chair have a comfortable lumbar back rest? When you sit back against the lumbar support is there ample space for your hips? Is the chair back rest large enough to provide good back support? Does the chair back recline and support your back in different positions? While one chair typically will not work for all, most chair manufacturers try to accommodate a wide variety of users through the inclusion of multiple adjustment points.

SUMMARY

The following simplified summary provides a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented below.

In some embodiments, a lumbar support device for a chair is provided, wherein the lumbar support device comprises a lumbar support, a seatback, and a lumbar support adjustment mechanism connecting the lumbar support to the seatback. In some embodiments, the lumbar support adjustment mechanism further comprises a lumbar spring, a lumbar mount comprising a vertical wall, a lumbar-end flange extending orthogonally forward from the vertical wall, a back-end flange extending orthogonally aftward from the vertical wall; and a spring pin connecting the lumbar spring to the lumbar mount.

In some embodiments, the lumbar support further comprises a lumbar support frame and contact surface. In some embodiments, the lumbar support frame further comprises a two outer columns and two inner columns, the two outer columns and two inner columns separated by a plurality of horizontal beams, wherein the separation of the two inner columns forms a vertical slot to which the lumbar support attachment mechanism connects.

In some embodiments, the seatback further comprises an inner shell and an outer shell. The inner shell may further comprise a housing to which the lumbar support attachment mechanism connects. The housing of the inner shell may further comprise mechanical interlocks located on an interior surface of the housing and wherein the mechanical interlocks interface with mechanical interlocks of the back-end flange of the lumbar support adjustment mechanism for adjusting and setting the forward and aft position of a lumbar support frame.

In some embodiments, the lumbar support adjustment mechanism may further comprise a lumbar spring through which the lumbar-end flange passes, and a spring pin securing the lumbar support adjustment mechanism to the lumbar support, and a screw and nut assembly that passes through an aperture in the back-end flange, securing the lumbar support adjustment mechanism to the seatback The back-end flange further comprises mechanical interlocks which interface with complementary mechanical interlocks located on an interior surface of a housing of the seatback. The back-end flange may also further comprise an oblong channel within which the nut is seated, and wherein the oblong channel prevents the nut from rotating when engaged by the screw.

In some embodiments, the lumbar support adjustment mechanism may further comprise an aperture through the lumbar spring, and wherein the lumbar-end flange of the lumbar mount passes through the aperture in the lumbar spring.

In some embodiments, a method for adjusting and locking a lumbar support relative to a seatback is provided. The foregoing method may comprise the steps of (i) connecting a lumbar support to a seatback using a lumbar support adjustment mechanism, wherein the lumbar support adjustment mechanism comprises a flange extending aftward and mechanical interlocks located on a surface of the flange for engaging the seatback, (ii) moving the lumbar support to a desired position fore or aft relative to the seatback, and (iii) locking the lumbar support in place relative to the seatback.

In some embodiments, the method may further use a seatback comprising a housing having mechanical interlocks on an internal surface for engaging the aftward extending flange of the lumbar support adjustment mechanism.

In some embodiments, the method for adjusting and locking a lumbar support relative to a seatback may further comprise the steps of turning a screw which extends through a housing in the seatback and an aperture in the aftward extending flange into a nut positioned in an oblong channel in the aftward extending flange.

DETAILED DESCRIPTION

With the advent of ergonomics, task or office chairs have incorporated multiple adjustment points to prevent injuries and allow users a more customized fit. Common adjustment points include seat height, seat depth, back angle, arm rest height, and lumbar support. As mentioned above, lumbar support is critical, especially for those suffering from lumbar back pain or injuries.

Many task chairs include some sort of lumbar support system. The systems range from basic padding to inflatable balloons. In some chairs, the lumbar support can be adjusted to move up or down relative to the seated user. Others may employ tilt adjustment mechanisms relative to the seated user. Depending on the system, the lumbar support can either disappear due to compression of the padding or move as the mechanics holding it in place slip with time and use.

The disclosure herein is related to a lumbar support adjustment mechanism that allows the lumbar support to be adjusted not only vertically, but also horizontally—forward or aft as it relates to the seated user. This movement accommodates a variety of lower back curvatures. Once set, the mechanism prevents forward or aft movement of the lumbar support.

When the terms "one," "a," or "an" are used in this disclosure, they mean "at least one" or "one or more," unless otherwise indicated.

Figure 1:
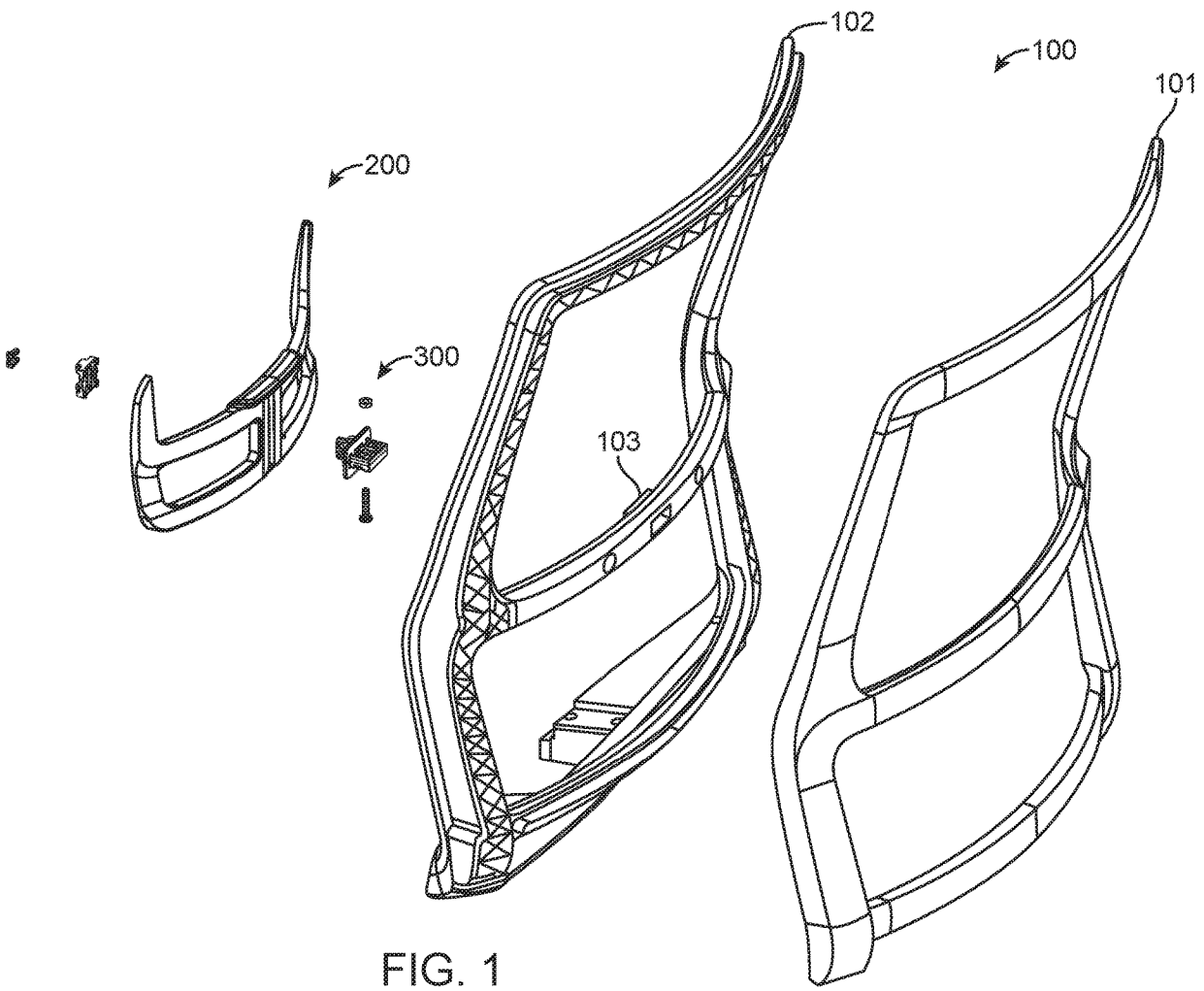
FIG. 1 is an exploded view of a non-limiting embodiment of the lumbar support frame, seatback frame, and lumbar support adjustment mechanism.

Turning to the figures, FIG. 1 is an exploded view of a seat back frame 100 having an outer shell 101, and inner shell 102, a lumbar support 200, and the components of the lumbar support adjustment mechanism (herein referred to as "LSAM") 300. Lumbar support 200 is attached to the seatback frame 100 using the LSAM 300. The seatback frame 100 may alternatively be referred to herein as the "seatback."

Figure 3:
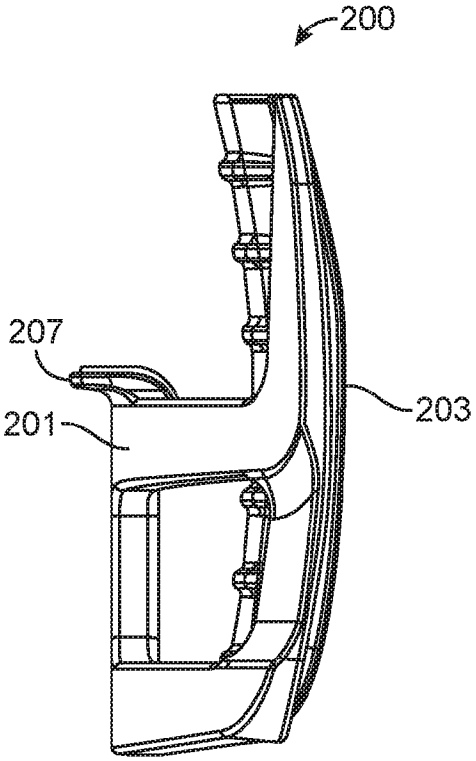
FIG. 3 is a side view of the lumbar support frame.
Figure 2:
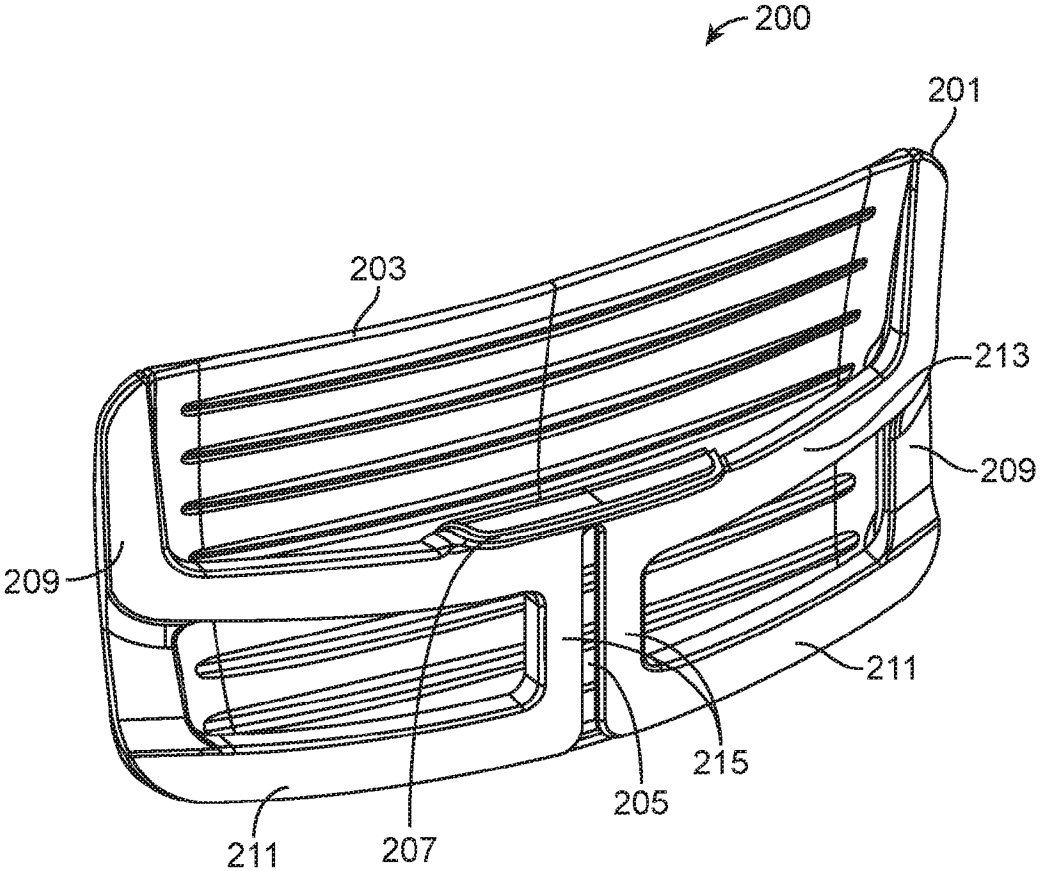
FIG. 2 is a perspective view of the lumbar support frame.

FIGS. 2 and 3 are a perspective and side view, respectively, of lumbar support 200. Lumbar support 200 has a support frame 201 on the back side and a contact surface 203 on the front side. The contact surface 203 may be made of a variety of supporting materials, including, without limitation, fabric, mesh, silicone, rubber, plastic, and foam. In at least one embodiment, the lumbar support contact surface is positioned behind the seatback surface of a chair to prevent unwanted deflection in the seatback surface and to support a user's lumbar region. In one embodiment, the support frame 201 has two outer columns 209 to support the contact surface 203 extending upwardly separated from one another by a plurality of horizontal beams 211 and two inner columns 215 that are also separated by the plurality of horizontal beams 211. The separation between the two inner columns 215 forms a vertical slot 205 in the center of the lumbar support frame 201. Above the vertical slot 205 generally in the middle of the lumbar support frame 201 is a flange 207 extending rearwardly for a user to grasp when adjusting the support 200 relative to the seatback frame 100. The LSAM 300 attaches to support frame 201 through vertical slot 205. Vertical slot 205 allows for adjusting the height of lumbar support 200 up or down to fit the user.

Figure 4:
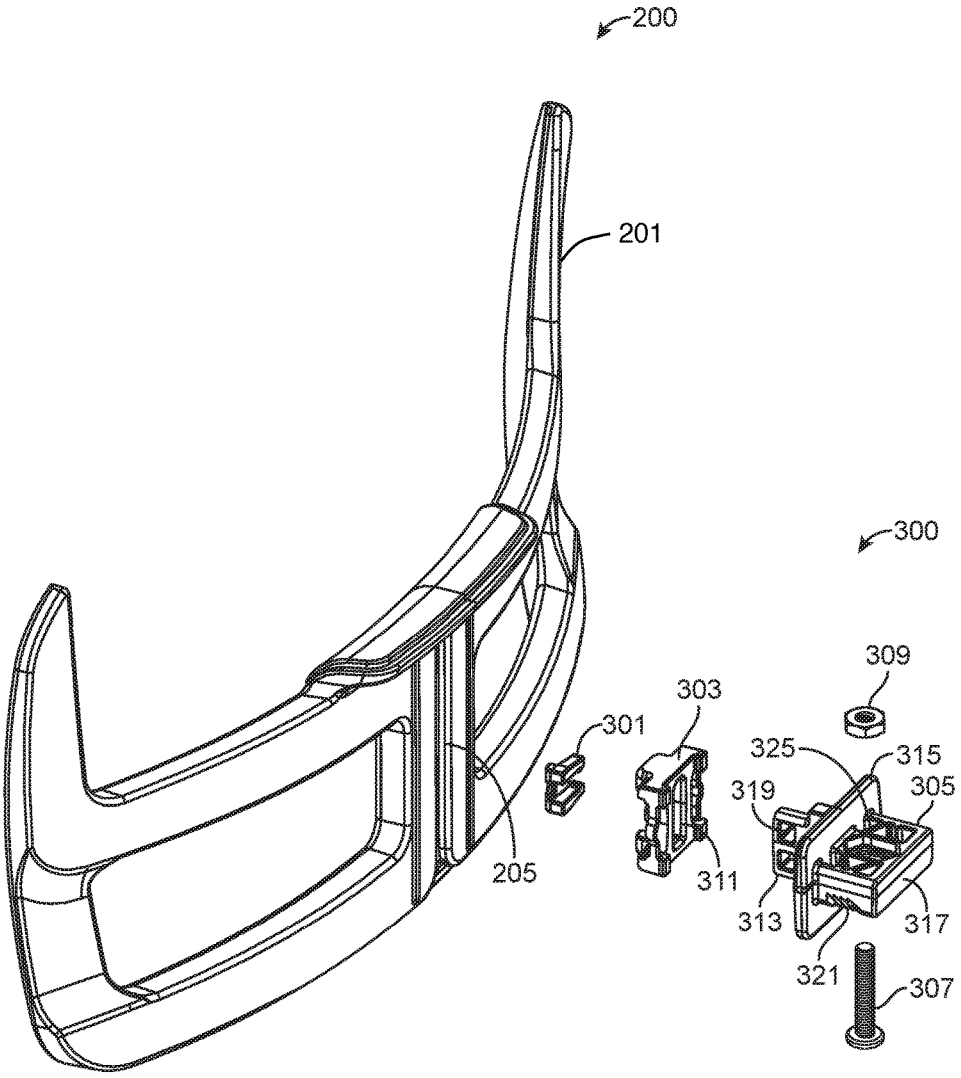
FIG. 4 is an exploded view of a non-limiting embodiment of the lumbar support frame and lumbar support adjustment mechanism.

FIG. 4 is a close-up exploded view of the lumbar support frame 201 of lumbar support 200 and components of the LSAM 300. The components include a spring pin 301, a lumbar spring 303, a lumbar mount 305, a screw 307, and a nut 309.

Spring pin 301 is used to attach lumbar spring 303 to lumbar mount 305. Spring pin 301 may comprise two horizontal prongs separated by a vertical bridge. The horizontal prongs of spring pin 301 seat into horizontal channels or ridges on the forward face of the lumbar spring 303 through openings in lumbar mount 305. The spring pin 301 attaches the lumbar spring 303 to the lumbar mount 305 by inserting the pin on one side wherein the bridge between the prongs limits further horizontal movement of the pin 301. Thus, when assembled, the spring pin 301 prevents horizontal or vertical disconnection as between the lumbar spring 303 and the lumbar mount 305. Alternatively, spring pin 301 may be a single prong or three prongs or four prongs or any number of prongs that will fit within space constraints of the end of lumbar spring 303 and lumbar mount 305. In embodiments where spring pin 301 has more than one prong, the prongs may be held together with a strip of material, such as the aforementioned vertical bridge. Spring pin 301 may be made from a variety of materials. Non-limiting examples include plastic, polymers, metal, wood, etc.

Lumbar spring 303 may be annular or ring shaped. However, the ring may be based on a circle, square, rectangle, or other polygonal shape. In the embodiment shown in FIG. 4, lumbar spring 303 is a rectangular ring shape having an aperture 311 extending vertically in the center of the ring. As discussed more fully below, a lumbar end 313 of the lumbar mount 305 extends through the aperture 311 of the lumbar spring 303. Lumbar spring 303 may be made from a variety of materials. Non-limiting examples include, plastic, polymers, foam, metal, wood, etc.

Lumbar mount 305 comprises a vertical wall 315 from which two flanges extend, one on each side. The frontward flange 313 is also a vertical flange that extends orthogonally from the vertical wall 315 and defines the lumbar end 313 of the lumbar mount 305 that attaches to lumbar support frame 200. The rearward flange 317 is a horizontal flange that extends orthogonally in the opposite direction from the lumbar end 313, and generally defines the back end 317 of the lumbar mount 305. In one embodiment, the rearward end flange 317 is thicker than the lumbar end flange. The back end 317 of the lumbar mount 305 attaches to a housing 103 in the seatback frame 100. In the embodiment shown in FIG. 4, lumbar end 313 and back end 317 each are planar in shape and are at 180-degree angle to each other on a first axis and are at 90-degree angle to each other on a second axis such that lumbar end 313 is vertical and back end 317 is horizontal. However, other shapes and configurations are contemplated. In this embodiment, lumbar end 313 and back end 317 are separated by vertical wall 315. Vertical wall 315 helps control the insertion depth as well as provide stability. Lumbar mount 305 may be made from a variety of different materials. Non-limiting examples include: plastic, polymer, metal, wood, etc.

Lumbar end 313 is designed to fit into vertical slot 205. Lumbar end 313 also has the same number of openings 319 as prongs found on spring pin 301. When attaching lumbar mount 305 to lumbar support frame 201, lumbar end 313 passes into vertical slot 205. Once through vertical slot 205, lumbar end 313 then passes through lumbar spring 303. Once through lumbar spring 303, spring pin 301 is placed in opening(s) 319. Lumbar support frame 201 is therefore sandwiched between lumbar spring 303 and vertical wall 315 of lumbar mount 305. In this embodiment, vertical wall 315 mates to each side of the slot 205 of the lumbar support frame 201 to limit the maximum distance by which the lumbar end 317 of the lumbar mount 305 may be inserted into the slot 205.

Figure 6:
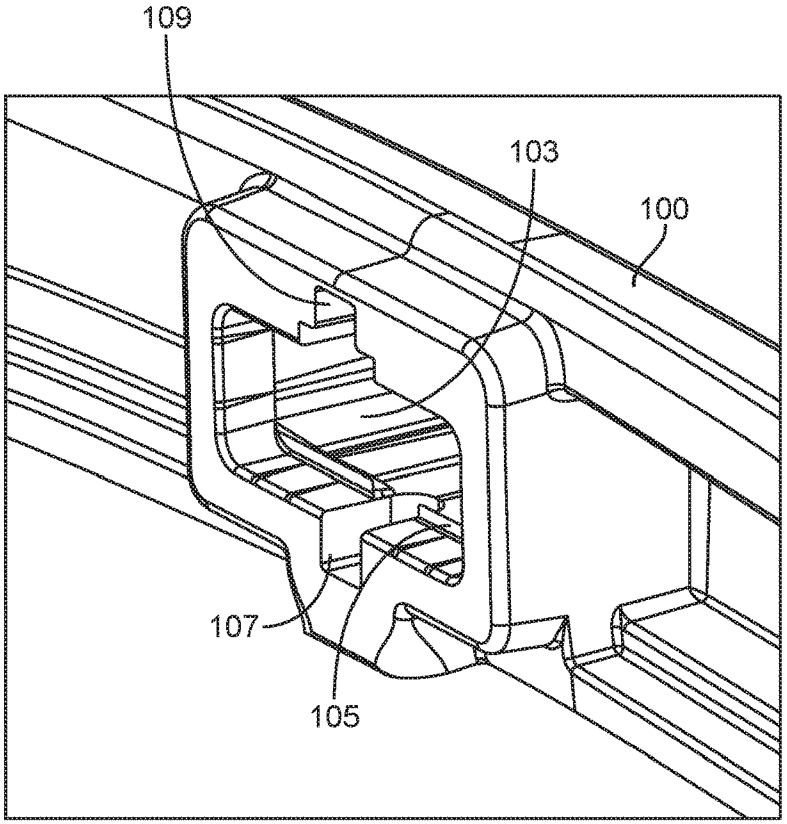
FIG. 6 is a perspective view of a non-limiting embodiment of the seatback frame housing of the lumbar support adjustment mechanism.
Figure 5:
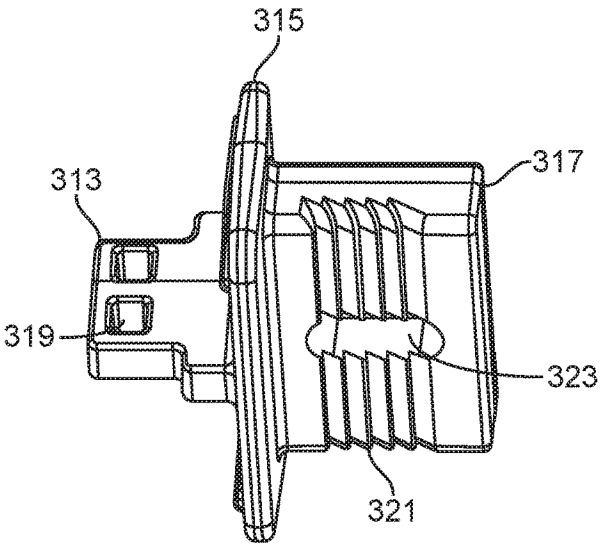
FIG. 5 is a perspective view of a non-limiting embodiment of the components of the lumbar support adjustment mechanism.

Back end 317 is designed to fit into a housing 103 on the seatback frame 100 as shown in FIG. 6. Also seen in FIG. 6, are an upper channel 109 and a lower channel 107 in the housing 103. The upper and lower channels 109, 107 accommodate for the insertion of the screw and nut assembly. At least one side of back end 317 has interlocks 321 taking the form of ridges, teeth, detents, or other mechanical interlocking features; and the matching interior side of housing 103 has complementary interlocks 105 taking the form of ridges, teeth, detents, or other mechanical interlocking features. In one embodiment, the mechanical interlocks 321 of the back end 317 of the lumbar mount 305 are on the bottom surface of the orthogonal flange defining the back end 317 and extend downwardly. In one embodiment, the mechanical interlocks 105 of the housing 103 are on the lower surface of the housing 103 and extend upwardly to complement the downwardly facing mechanical interlocks 321 of the lumbar mount 305. Back end 317 also has at least one opening 323 through which screw 307 passes. In the embodiment shown in FIGS. 4, 5, and 6, the opening is oblong shaped, however, other shapes are contemplated. Also contemplated are multiple separate openings. Screw 307 is held in place by nut 309. In the embodiment shown in FIGS. 4 and 6, the surface where nut 309 interfaces with back end 317 is an oblong channel 325 on the top surface of the flange 317, the depth of which matches the thickness of nut 309, creating a well or depression 325 in which nut 309 is seated. The horizontal width of the channel 325 also matches the width of the nut, with each end of the oblong channel being shaped to match the polygonal corners of the nut used. The channel orientation and dimensions prevents for the rotation of the nut 309 when seated in the channel 325.

Figure 7:
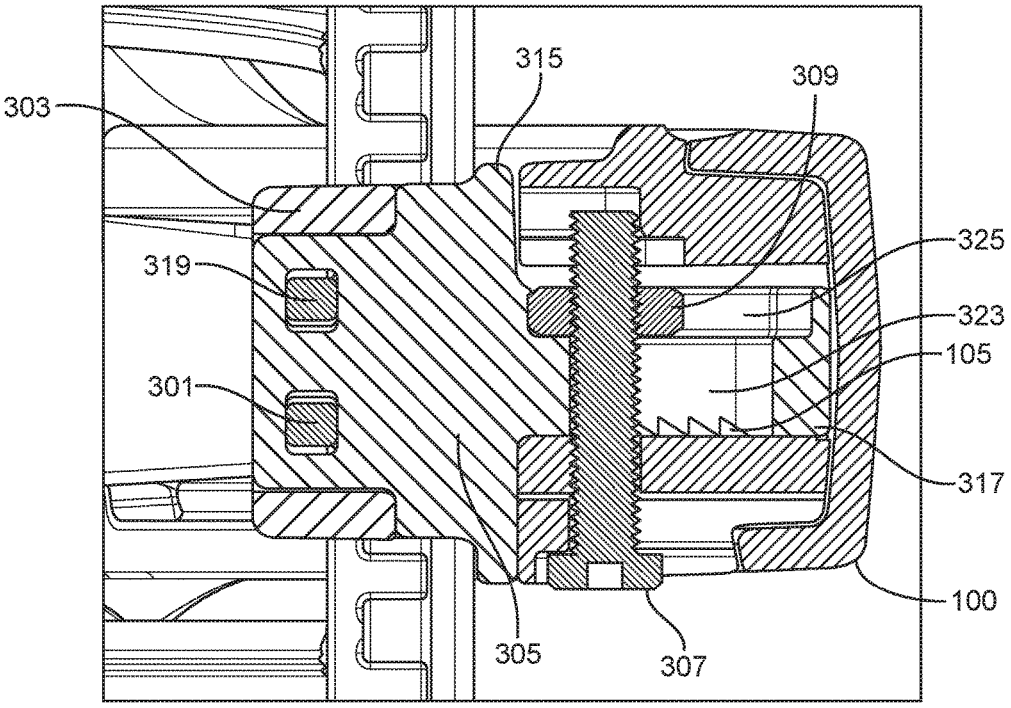
FIG. 7 is a cross-sectional view of a non-limiting embodiment of the lumbar support adjustment mechanism assembled into the lumbar support frame and seatback housing.

As seen in FIG. 7, the screw 307 also passes through housing 103 of seatback fame 100 from the bottom, although other configurations are contemplated. Tightening of screw 307 and nut 309 engages lumbar mount interlocks 321 to the lumbar housing interlocks 105, thus preventing forward or aft movement of lumbar support 200 when lumbar support 200 has been assembled to LSAM 300. In one embodiment, lumbar mount interlocks 321 are ridges which are vertical on one side and chamfered on the other side, while lumbar housing interlocks 105 are complementary vertical and chamfered on the alternative sides. This permits for a user to extend the lumbar support 200 forward toward the user, by slightly loosening the screw without removing it entirely, and by allowing the complementary interlocks to slide past one another in the direction of extending the lumbar support 200 forward toward a user. However, because the screw 307 is only partially loosened, the vertical sides of the complementary interlocks 105, 321 would interface to prevent LSAM 300 and thereby, lumbar support 200, from sliding aftward. Once the desired forward position of a lumbar support 200 has been set by extending the LSAM 300 forward, it is important that the LSAM 300 does not translate or slip aftward, as a result of pressure applied by the user, as such translation would negate the support imparted by the lumbar support 200. Once the position is set at the desired translation, the assembler or user next tightens the screw to lock the position in place and prevent aftward translation due to the in-use pressure of the user.

Figure 9:
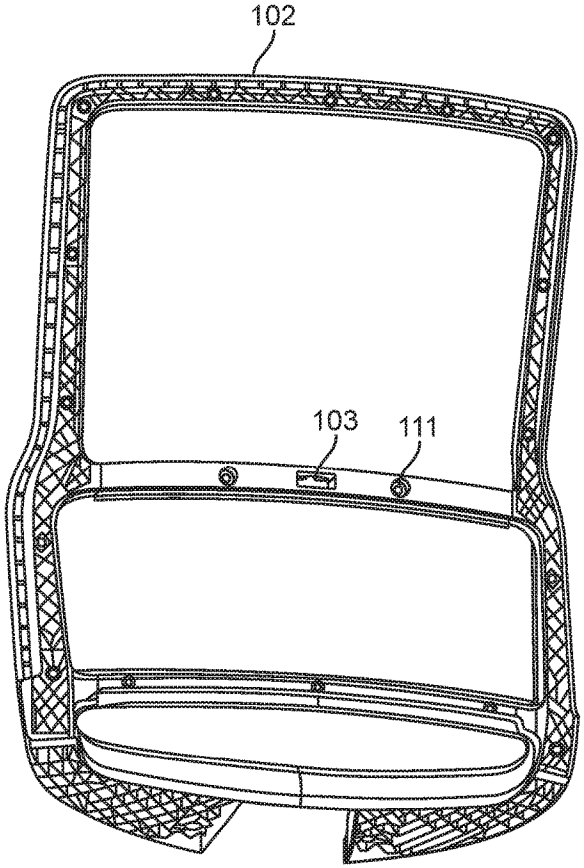
FIG. 9 is a rear perspective view of the inner shell of the seatback frame having a housing for the lumbar support adjustment mechanism.
Figure 8:
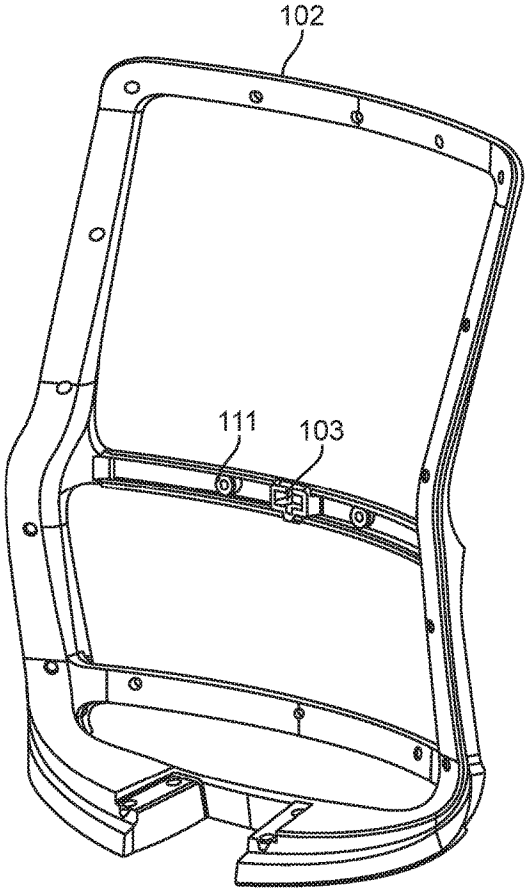
FIG. 8 is a front perspective view of the inner shell of the seatback frame having a housing for the lumbar support adjustment mechanism.

Turning to FIGS. 8 and 9 are a front view (FIG. 8) and a rear view (FIG. 9) of the inner shell 102, of the seatback frame 100. The housing 103 for receiving the lumbar support adjustment mechanism is in view, as well as connector mounts 111 for connecting the inner shell 102 to the other portions of the seatback frame 100, such as the outer shell 101.

Many alterations and modifications may be made by those having ordinary skill in the art without departing from the spirit and scope of the embodiments disclosed and described herein. Therefore, it is understood that the illustrated and described embodiments have been set forth only for the purposes of examples and that they are not to be taken as limiting the embodiments as defined by the following claims. For example, notwithstanding the fact that the elements of a claim are set forth below in a certain combination, it must be expressly understood that the embodiments include other combinations of fewer, more or different elements, which are disclosed above even when not initially claimed in such combinations.

The definitions of the words or elements of the following claims are, therefore, defined in this specification to not only include the combination of elements which are literally set forth. It is also contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination(s).

Furthermore, to the extent that the term "having," "includes," or "wherein" is used in either the detailed description or the claims, such term is intended to be inclusive in a manner similar to the term "comprising" as "comprising" is interpreted when employed as a transitional word in a claim.

What is claimed is:

1. A lumbar support device for a chair, comprising:
a lumbar support,
a seatback,
a lumbar support adjustment mechanism connecting the lumbar support to the seatback; wherein the lumbar support adjustment mechanism comprises:
a lumbar mount having a back end flange extending aftward and mechanical interlocks located on a surface of the back end flange for engaging the seatback and adjusting the lumbar support fore and aft relative to the seatback and locking the lumbar support in place relative to the seatback;
wherein the lumbar support comprises a lumbar support frame and a contact surface for providing lumbar support to a user's back;
wherein the lumbar support frame further comprises a vertical slot through which the lumbar support attachment mechanism connects; and
wherein the vertical slot allows for adjusting the height of the lumbar support up or down.

2. The lumbar support device of claim 1, wherein the lumbar support frame further comprises a plurality of vertical columns separated by a plurality of horizontal beams, wherein the separation of the plurality of columns forms the vertical slot.

3. A lumbar support device for a chair, comprising:
a lumbar support,
a seatback, a lumbar support adjustment mechanism connecting the lumbar support to the seatback; wherein the lumbar support adjustment mechanism comprises:

a lumbar mount having a back end flange extending aftward and mechanical interlocks located on a surface of the back end flange for engaging the seatback and adjusting the lumbar support fore and aft relative to the seatback and locking the lumbar support in place relative to the seatback;

wherein the lumbar support adjustment mechanism further comprises a vertical wall from which the back-end flange extends, and a lumbar-end flange extending orthogonally forward from the vertical wall; and wherein the lumbar support adjustment mechanism further comprises a lumbar spring having an aperture through which the lumbar-end flange passes, a spring pin securing the lumbar support adjustment mechanism to the lumbar support, and a screw and nut assembly wherein the screw passes through an aperture in the back-end flange, securing the lumbar support adjustment mechanism to the seatback.

4. The lumbar support device of claim 3, wherein the back-end flange further comprises an oblong channel within which the nut is seated, and wherein the oblong channel is shaped to prevent the nut from rotating when engaged by the screw.

5. A lumbar support adjustment mechanism for a chair comprising:

a lumbar spring, a lumbar mount, further comprising:

a vertical wall, a lumbar-end flange extending orthogonally forward from the vertical wall, a back-end flange extending orthogonally aftward from the vertical wall and further comprises mechanical interlocks located on a surface of the back-end flange, and a spring pin connecting the lumbar spring to the lumbar mount; and wherein the lumbar spring further comprises an aperture through which the lumbar-end flange passes and a screw and nut assembly wherein the screw passes through an aperture in the back-end flange, securing the lumbar support adjustment mechanism to the seatback.

6. The lumbar support adjustment mechanism of claim 5, wherein the back-end flange further comprises an oblong channel within which the nut is seated, and wherein the oblong channel is shaped to prevent the nut from rotating when engaged by the screw.

7. A method for adjusting and locking a lumbar support relative to a seatback comprising the steps of:

(i) connecting a lumbar support to a seatback using a lumbar support adjustment mechanism, wherein the lumbar support adjustment mechanism comprises a flange extending aftward and mechanical interlocks located on a surface of the flange for engaging the seatback, (ii) moving the lumbar support to a desired position fore or aft relative to the seatback, and (ii) locking the lumbar support in place relative to the seatback, wherein locking the lumbar support in place relative to the seatback further comprises the steps of turning a screw which extends through a housing in the seatback and an aperture in the aftward extending flange, into a nut positioned in an oblong channel in the aftward extending flange.

* * * * *